US008597105B2

(12) United States Patent
Kitagawa et al.

(10) Patent No.: US 8,597,105 B2
(45) Date of Patent: Dec. 3, 2013

(54) GAMING MACHINE

(75) Inventors: Shigehiko Kitagawa, Tokyo (JP); Hideaki Kishi, Tokyo (JP); Tatsuhiko Tanimura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 743 days.

(21) Appl. No.: 12/124,715

(22) Filed: May 21, 2008

(65) Prior Publication Data

US 2009/0005153 A1 Jan. 1, 2009

(30) Foreign Application Priority Data

Jun. 27, 2007 (JP) ..... 2007-169452

(51) Int. Cl.
*A63F 9/24* (2006.01)

(52) U.S. Cl.
USPC ..... 463/24; 463/43; 307/80; 307/66; 711/170; 711/165

(58) Field of Classification Search
USPC ..... 463/20, 24, 43; 307/80, 66; 711/170, 711/165
See application file for complete search history.

(56) References Cited

U.S. PATENT DOCUMENTS 4,607,844 A * 8/1986 Fullerton ..... 463/24
4,782,468 A * 11/1988 Jones et al. ..... 463/24
4,948,138 A * 8/1990 Pease et al. ..... 463/24
5,430,365 A * 7/1995 Taylor et al. ..... 323/273
5,578,876 A * 11/1996 Crampton ..... 307/80
5,879,234 A * 3/1999 Mengual ..... 463/20
5,923,249 A * 7/1999 Muir ..... 340/545.1
5,942,811 A * 8/1999 Stumfall et al. ..... 307/64

(Continued)

FOREIGN PATENT DOCUMENTS

EP 1117079 7/2001
JP 2003190587 7/2003

(Continued)

OTHER PUBLICATIONS

International Search Report, Feb. 12, 2009.

(Continued)

*Primary Examiner* — David L Lewis
*Assistant Examiner* — Chase Leichliter
(74) *Attorney, Agent, or Firm* — Lexyoume IP Meister, PLLC.

(57) ABSTRACT

A gaming machine is provided, which includes an interface portion, a controller, a memory, a first power supply, and a second power supply. The interface portion is connected with at least one unit used for executing a game. The controller controls the unit connected to the interface portion and detects an occurrence of abnormal operation at the unit. The memory stores identification information for identifying the unit, and further stores historical information that includes information related to the occurrence of abnormal operation detected by the controller in connection with the identification information. The first power supply supplies a voltage required for operation of the controller. The second power supply supplies the voltage required for operation of the controller if a voltage supplied for the controller by the first power supply is less than the voltage required for operation of the controller.

9 Claims, 6 Drawing Sheets

(56) References Cited

U.S. PATENT DOCUMENTS

| | | | | |
|---|---|---|---|---|
| 6,804,763 | B1 * | 10/2004 | Stockdale et al. | 711/170 |
| 6,864,666 | B2 * | 3/2005 | Breen et al. | 320/135 |
| 6,866,581 | B2 * | 3/2005 | Martinek et al. | 463/16 |
| 7,047,338 | B1 * | 5/2006 | Nguyen et al. | 710/302 |
| 7,196,495 | B1 * | 3/2007 | Burcham | 320/134 |
| 7,647,329 | B1 * | 1/2010 | Fischman et al. | 707/999.1 |
| 7,661,676 | B2 * | 2/2010 | Smith et al. | 273/149 R |
| 7,838,142 | B2 * | 11/2010 | Scheucher | 429/99 |
| 2002/0187833 | A1 * | 12/2002 | Nishiyama et al. | 463/40 |
| 2006/0240888 | A1 | 10/2006 | Tanimura | |
| 2006/0247004 | A1 | 11/2006 | Tanimura | |
| 2006/0247005 | A1 | 11/2006 | Tanimura | |
| 2006/0248373 | A1 * | 11/2006 | Warman et al. | 714/4 |

FOREIGN PATENT DOCUMENTS

| | | |
|---|---|---|
| JP | 2006115864 | 5/2006 |
| JP | 2006271685 | 10/2006 |
| JP | 2007069044 | 3/2007 |

OTHER PUBLICATIONS

Official Action and International Style Search Report from corresponding Macau application No. I/822; English translations included.

* cited by examiner

GAMING MACHINE

This application is based on and claims the benefit of priority from Japanese Patent Application No. 2007-169452, filed on 27 Jun. 2007, the content of which is incorporated herein by reference.

BACKGROUND OF THE INVENTION

1. Field of the Invention

The present invention relates to a gaming machine such as a slot machine.

2. Related Art

Basically, gaming machines installed in an amusement facility such as a casino that is open 24 hours a day operate 24 hours without downtime, except for maintenance work. Therefore, such gaming machines are likely to be at high risk for attempts at tampering with components installed inside the cabinet, CPU and a control board, for example. In order to prevent such attempts, it is preferable to protect the components with the highest care, which play the most important roles for normal operation of a gaming machine, the CPU, the control board, and a memory to store gaming information, for example.

U.S. Patent Applications, First Publication Nos. 2006/0240888, 2006/0247004, and 2006/0247005 disclose gaming machines that have protection against the attempts described above. These gaming machines, which have a memory card storing gaming information that is attachable and detachable from a gaming board, perform authentication for the gaming information so as to prevent the dishonest attempts described above. More specifically, the gaming machine authenticates the memory card by a main CPU provided on a motherboard, upon turning on of a main power supply. It is only if the authentication of the memory card is successful that the gaming machine starts a game. In this way, the gaming machine can prevent dishonest acts with removal of the memory card storing the gaming information, followed by duplication and dishonest alteration of the gaming information, for example.

However, the gaming machine installed in the casino that is open 24 hours a day may encounter an accident where a main power supply of the gaming machine is turned off due to a blackout or a malfunction of the gaming machine, for example. The gaming machines disclosed in the U.S. Patent Applications described above require the main power supply to be in an ON state in order to activate software for authenticating the memory card. That is, such gaming machines cannot authenticate the memory card or perform acquisition and recording of logs relating to removal and insertion of the memory card while the main power supply is in an OFF state.

When a dishonest act is performed, which is accompanied by removal of the memory card while the main power supply is in an OFF state, it is feared that it takes much time and effort to specify the contents and location of the dishonest act. Since the gaming machine installed in the casino that is open 24 hours a day is at high risk for the dishonest acts, it is preferable that the security of the gaming machine is maintained even though the power supply of the gaming machine is in an OFF state.

SUMMARY OF THE INVENTION

A gaming machine is provided, which can maintain its security even though the voltage imposed on a controller by a main power supply of the gaming machine is lower than a threshold required for operation of the controller.

In an aspect of the present invention, a gaming machine is provided, which includes an interface portion (a motherboard 50 and gaming board 60, e.g.), a controller (a main CPU 51 and CPU 67, e.g.), a memory (RAM 53, RAM 63 and flash memory 114, e.g.), a first power supply (a main power supply unit 90, e.g.), and a second power supply (a backup power supply 91 and gaming board backup power supply 73). The interface portion is connected with at least one unit (a door sensor 24 and game cartridge 75, e.g.) used for executing a game. The controller controls the unit connected to the interface portion and detects an occurrence of abnormal operation at the unit. The memory stores identification information for identifying the unit, and further stores historical information that includes information related to the occurrence of abnormal operation detected by the controller in connection with the identification information. The first power supply supplies a voltage required for operation of the controller. The second power supply supplies the voltage required for operation of the controller if a voltage supplied for the controller by the first power supply is less than the voltage required for operation of the controller.

With the gaming machine described above, the information related to the occurrence of abnormal operation at a unit is stored in the memory as the historical information, even if the abnormal operation occurs against an administrator's expectation. Accordingly, the administrator can easily specify the contents and the location of the abnormal operation based on the stored historical information. In this way, even if the first power supply fails to supply the required voltage for the controller, it is possible to maintain the security of the gaming machine.

In another aspect of the present invention, a gaming machine is provided, which further includes a removal memory that is attachably and detachably connected with the interface portion and that stores the historical information.

With the gaming machine described above, the historical information is stored not only in the memory but also in the removal memory. In this way, it is possible to perform a parallel analysis or comparison between the historical information stored in these two separate memories. In addition, the removal memory allows the analysis without terminating the gaming machine.

In still another aspect of the present invention, a gaming machine is provided, further comprising a time counter (RTC 59, RTC 71 and RTC 116, e.g.), in which the memory and the removal memory further store information related to a time counted by the time counter and the time is correlated with the historical information.

Since the gaming machine described above allows the administrator to specify the time of the occurrence of abnormal operation, she can analyze the historical information more in detail and quickly.

In yet another aspect of the present invention, a gaming machine is provided, in which the second power supply includes a first secondary power supply (lithium batteries 91*a* and 73*a*, e.g.) and a second secondary power supply (electrolytic capacitors 91*b* and 73*b*, e.g.). The first secondary power supply is charged by the first power supply, and if a voltage supplied for the controller by the first power supply is less than the voltage required for operation of the controller, the first secondary power supply supplies a voltage for the controller. The second secondary power supply is charged by the first power supply, and if both voltages supplied for the controller by the first power supply and the first secondary power supply are less than the voltage required for operation of the controller, the second secondary power supply supplies a voltage for the controller.

The gaming machine described above, whose second power supply includes two secondary power supplies, can supply the voltage for the controller with one of these two secondary power supplies in case of failure of the first power supply so as not to fail to acquire the historical information. In addition, since the second power supply has the first and second secondary power supplies, it is possible to continuously supply a voltage for the controller by replacing one secondary power supply at a time.

In a further aspect of the present invention, a gaming machine is provided, in which the historical information stored in the memory is encrypted.

The gaming machine described above can increase the security of the historical information.

DETAILED DESCRIPTION OF THE INVENTION

An embodiment of the present invention is described below with reference to the accompanying drawings.

Figure 1:
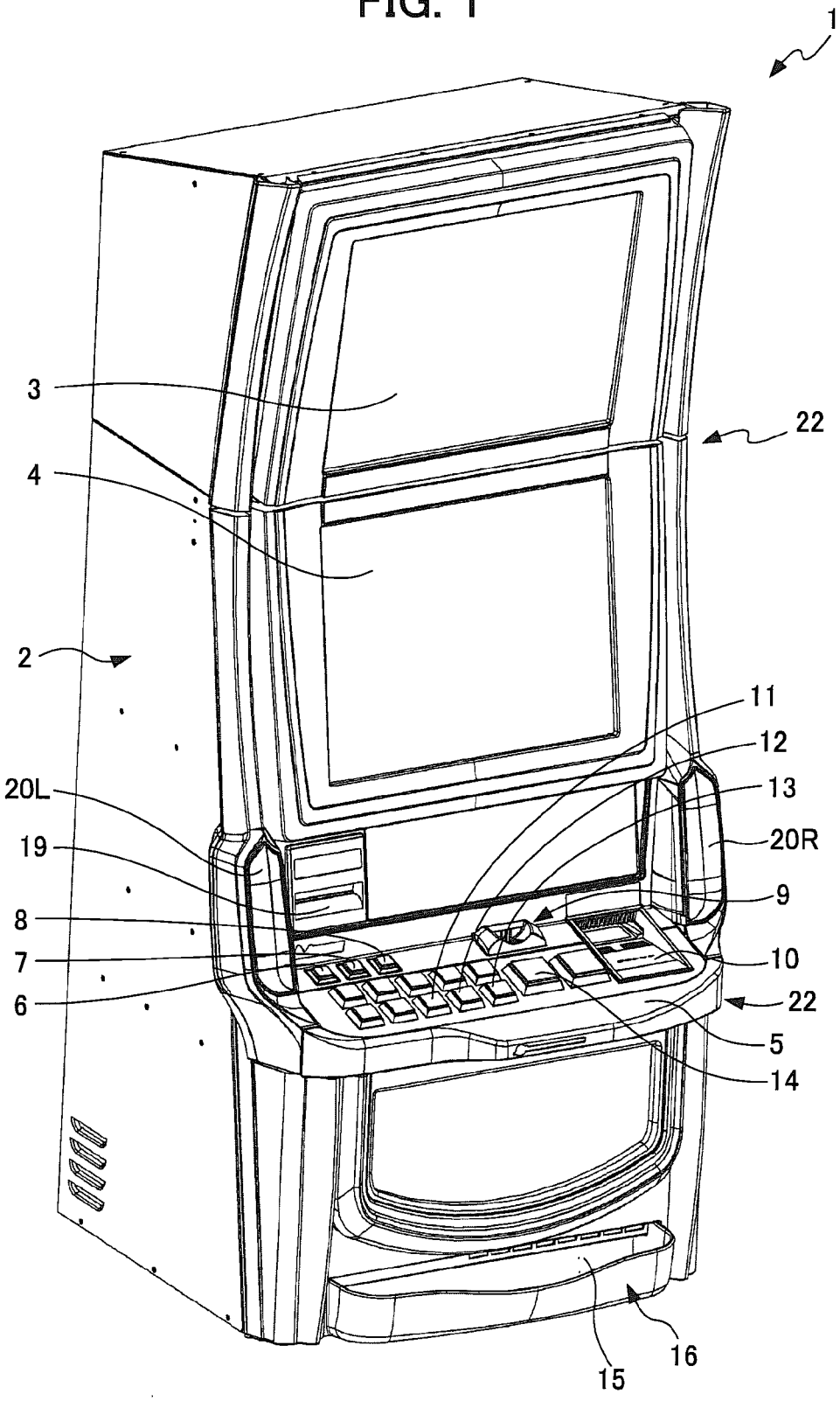
FIG. 1 is a perspective view showing an external appearance of a gaming machine according to the present invention.

FIG. 1 is a perspective view showing a configuration of an external appearance of a gaming machine 1 according to an embodiment of the present invention. The gaming machine 1 is a so-called upright slot machine installed at an amusement facility such as a casino. The gaming machine 1 is provided with a cabinet 2 storing electric or mechanical parts for executing a game and a front door 22 that can open and close a front of the cabinet 2. A sub display 3 is provided in an upper front portion of the cabinet 2. In addition, a main display 4 is provided below the sub display 3 in the front door 22.

The sub display 3 constituted of a liquid crystal display displays an award table, which shows odds and the like indicating an award per single medal provided for a player winning the game, while the gaming machine 1 is in a base game or a standby state. The sub display 3 is tilted forward with respect to the gaming machine 1 so as to be more visually beneficial to the player, whose line of sight lies substantially at a height of the main display 4.

The main display 4 is a panel that provides a display of rotation of symbols to which a player pays continuous attention. The main display 4 has a transparent touch panel disposed on the front face thereof and a transparent liquid crystal display, which is translucent and fixed to the front door 22. Transparent display windows are provided in the main display 4 so that peripheral surfaces of a plurality of reels 33L, 33C, and 33R (see FIG. 2 described later) provided within the cabinet 2 can be visually recognized. These reels 33L, 33C, and 33R face the display windows in the main display 4.

A plurality of types of symbols is arranged on a peripheral surface of each of the reels 33L, 33C, and 33R so that three symbols are displayed in each display window in the main display 4. In addition, a plurality of paylines (not shown) extending horizontally and obliquely is displayed on the main display 4.

A winning combination is predetermined based on a combination of plurality of kinds of symbols. When a combination matching a winning combination of symbols is statically displayed along a payline, coins are discharged through a coin payout opening 15 in accordance with the winning combination. Nine symbols printed on a long slip of sticker, which has a compatible width and circumferential length of a reel, is typically attached to the circumferential surface of the reel. However, it is apparent that the symbols may alternatively be provided in other ways.

In the present embodiment, only a center line is set as a payline. The payline is displayed on the main display 4 when a player plays a game by rotating and stopping the reels by pressing a 1-bet button 11, 3-bet button 12, or 5-bet button 13, and then pressing a SPIN/REPEAT-bet button 14 (hereinafter referred to as a "spin button 14"). On the contrary, when a player plays various bonus games obtained, which provide special gaming modes advantageous to the player, by pressing the 5-bet button 13, the payline disappears from the main display 4.

A ticket printer 19 is installed on the left, below the main display 4, which outputs tickets with information in accordance with the result displayed on the main display 4.

An operation table 5 shaped like a table, on which a player can perform operations, is disposed below the main display 4. On the operation table 5, a CHANGE button 6, CASH OUT button 7, and HELP button 8 are disposed from the left as shown in FIG. 1. A coin slot 9 and a bill slot 10 are disposed on the right side of the HELP button 8. In addition, in a portion of the operation table 5 closer to a player with respect to the CHANGE button 6, the 1-bet button 11, the 3-bet button 12, and the 5-bet button 13 are disposed from the left as shown in FIG. 1. On the right side of the 5-bet button 13, the spin button 14 is disposed.

The CHANGE button 6 is pressed by a player to change a bill inserted into the bill slot 10. The changed coins are discharged through the coin payout opening 15 to a coin tray 16 provided in a lower portion of the cabinet 2. A CHANGE switch is connected to the CHANGE button 6. When the CHANGE button 6 is pressed by a player, the CHANGE switch outputs a switch signal to a main CPU 51 and the like, which control the gaming machine 1.

The CASH OUT button 7 is pressed by a player at the end of a base game to cash out coins obtained in the game to the coin tray 16 through the coin payout opening 15 below the front door 22. A CASH OUT switch is connected to the CASH OUT button 7. When the CASH OUT button 7 is pressed by a player, the CASH OUT switch outputs a switch signal to the main CPU 51 and the like, which control the gaming machine 1.

The HELP button 8 is pressed by a player when she is unfamiliar with how to play the game. When the HELP button 8 is pressed, a variety of help information is displayed on the sub display 3 and the main display 4. In addition, when the HELP button 8 is pressed while the award table is not displayed on the sub display 3 during a game, the award table is displayed on the sub display 3. A HELP switch is connected to the HELP button 8. When the HELP button 8 is pressed, the HELP switch outputs a switch signal to the main CPU 51 and the like, which control the gaming machine 1.

A coin sensor is disposed at the coin slot 9. When a coin is inserted into the coin slot 9, the coin sensor outputs a coin detection signal to the main CPU 51 and the like, which control the gaming machine 1. A bill sensor is disposed at the bill slot 10. When a bill is inserted into the bill slot 10, the bill sensor outputs a bill detection signal to the main CPU 51 and the like, which control the gaming machine 1.

The 1-bet button 11 is used to bet a coin one by one and can be pressed to bet up to three times. A 1-bet switch is connected to the 1-bet button 11. When the 1-bet button 11 is pressed, the 1-bet switch outputs a switch signal to the main CPU 51 and the like, which control the gaming machine 1.

The 3-bet button 12 is pressed to start a game with 3 coins bet. A 3-bet switch is connected to the 3-bet button 12. When the 3-bet button 12 is pressed, the 3-bet switch outputs a switch signal to the main CPU 51 and the like, which control the gaming machine 1. The 5-bet button 13 is pressed to start a game with 5 coins bet or to start a bonus game which provides a special gaming mode which is advantageous to the player. A 5-bet switch is connected to the 5-bet button 13. When the 5-bet button 13 is pressed, the 5-bet switch outputs a switch signal to the main CPU 51 and the like, which control the gaming machine 1.

The spin button 14 is used as a game start button to start a game on condition that a bet has been made by way of the bet button 11, 12 or 13. The spin button 14 is pressed by a player to start rotation of reels (described later) so as to execute a game with the present bet amount or the previous bet amount. A spin switch is connected to the spin button 14. When the spin button 14 is pressed, the spin switch outputs a switch signal to the main CPU 51 and the like, which control the gaming machine 1. In this connection, bet amounts allowed for a player to wager by pressing the spin button 14 are 1, 2, 3, and 5.

In addition, the coin payout opening 15 through which coins are discharged and the coin tray 16 which receives the discharged coins are disposed below the front door 22. A coin detection unit, which is composed of a sensor and the like, is disposed within the coin payout opening 15, and detects the number of coins discharged through the coin payout opening 15.

In addition, speakers 20L and 20R for producing sound effects of a game are disposed on both left and right terminal portions of the front door 22, respectively.

Figure 2:
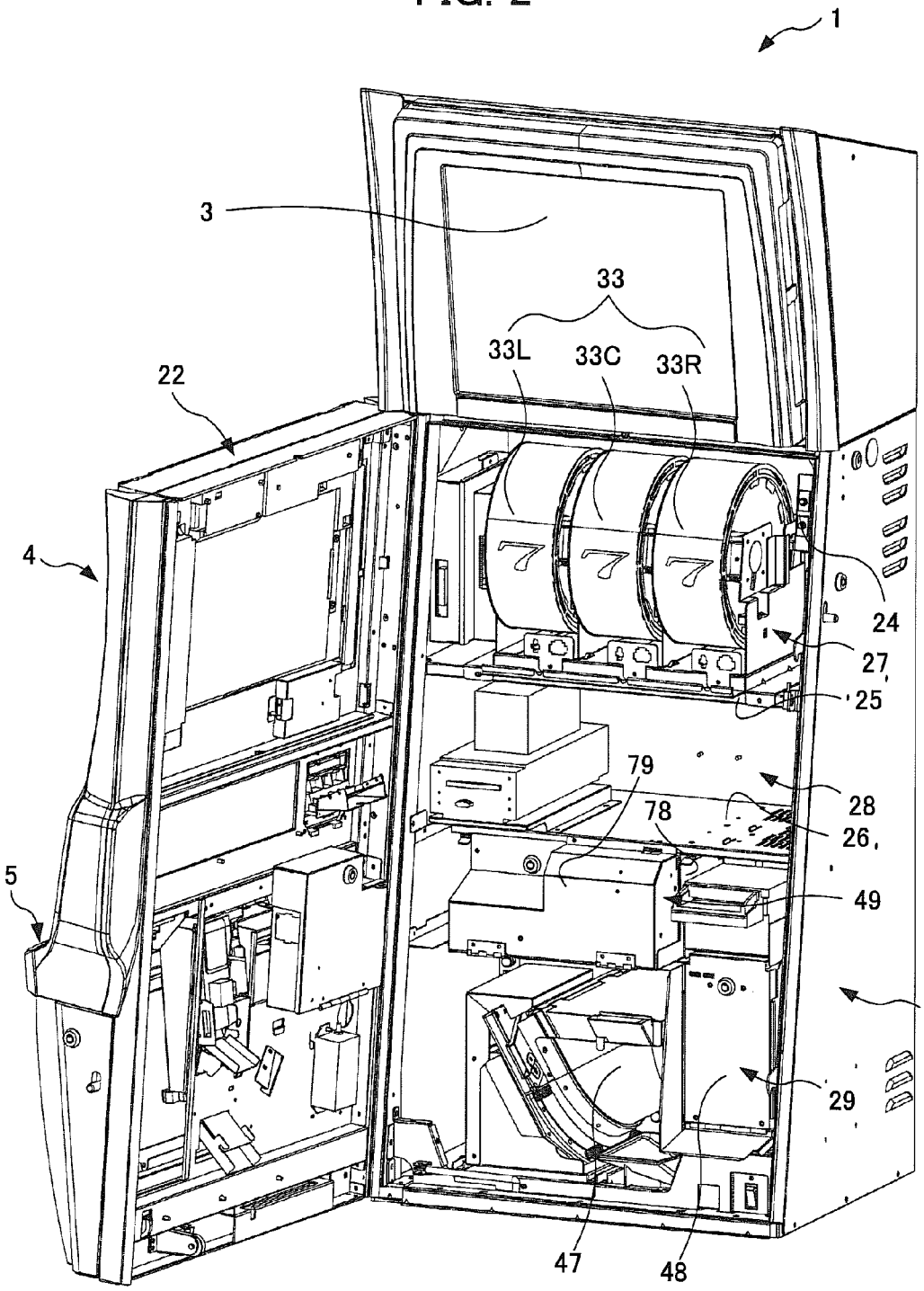
FIG. 2 is a perspective view showing an inner configuration of a cabinet of the gaming machine according to the present invention.

Next, an inner configuration of the cabinet 2 is described with reference to FIG. 2. FIG. 2 is a perspective view showing an inner configuration of the cabinet 2 of the gaming machine 1 with the front door 22 in an open position. As shown in FIG. 2, the cabinet 2 is a box-shaped cabinet having a front opening. The front door 22 can be opened and closed about an axis at one end of the cabinet 2 so as to cover the opening of the cabinet 2. In addition, a door sensor 24, which detects opening and closing of the front door 22 and outputs a detection signal to a control device 70 (described later), is attached to an edge of the cabinet 2. When the front door 22 is opened, the door sensor 24 turns to an OFF state. On the other hand, when the front door 22 is closed, the door sensor 24 turns to an ON state.

The inside of the cabinet 2 is divided into a cabinet upper portion 27, a cabinet middle portion 28, and a cabinet lower portion 29 by an upper shelf board 25 and a lower shelf board 26.

A reel unit 33 having three reels 33L, 33C, and 33R is provided in the cabinet upper portion 27. Each of the reels 33L, 33C, and 33R is cylindrically shaped, and is provided in the cabinet upper portion 27 with a peripheral surface thereof facing the main display 4 of the front door 22. The reel unit 33 rotatably supports the three reels 33L, 33C, and 33R, and is provided with a stepping motor (not shown) to rotate the three reels 33L, 33C, and 33R.

A main control unit 49 including a control device 70 (described later), a hopper 47, and a collecting box 48 are provided in the cabinet lower portion 29.

The hopper 47 holds coins inserted from the coin insertion slot 9, and discharges a predetermined number of coins, which pass through a coin shoot (not shown), through the coin payout opening 15 disposed in the front door 22 in response to an instruction from the control device 70. The collecting box 48 is a container for collecting and holding bills inserted into the bill insertion slot 10 disposed in the front door 22.

The main control unit 49 includes the control device 70, which is described later with reference to FIG. 3, a box-shaped CPU cabinet 78 for holding the control device 70, and a front cover 79 for opening and closing a front portion of the CPU cabinet 78. A game cartridge 75, which is described later, is exchangeable while the front cover 79 is open.

Figure 3:
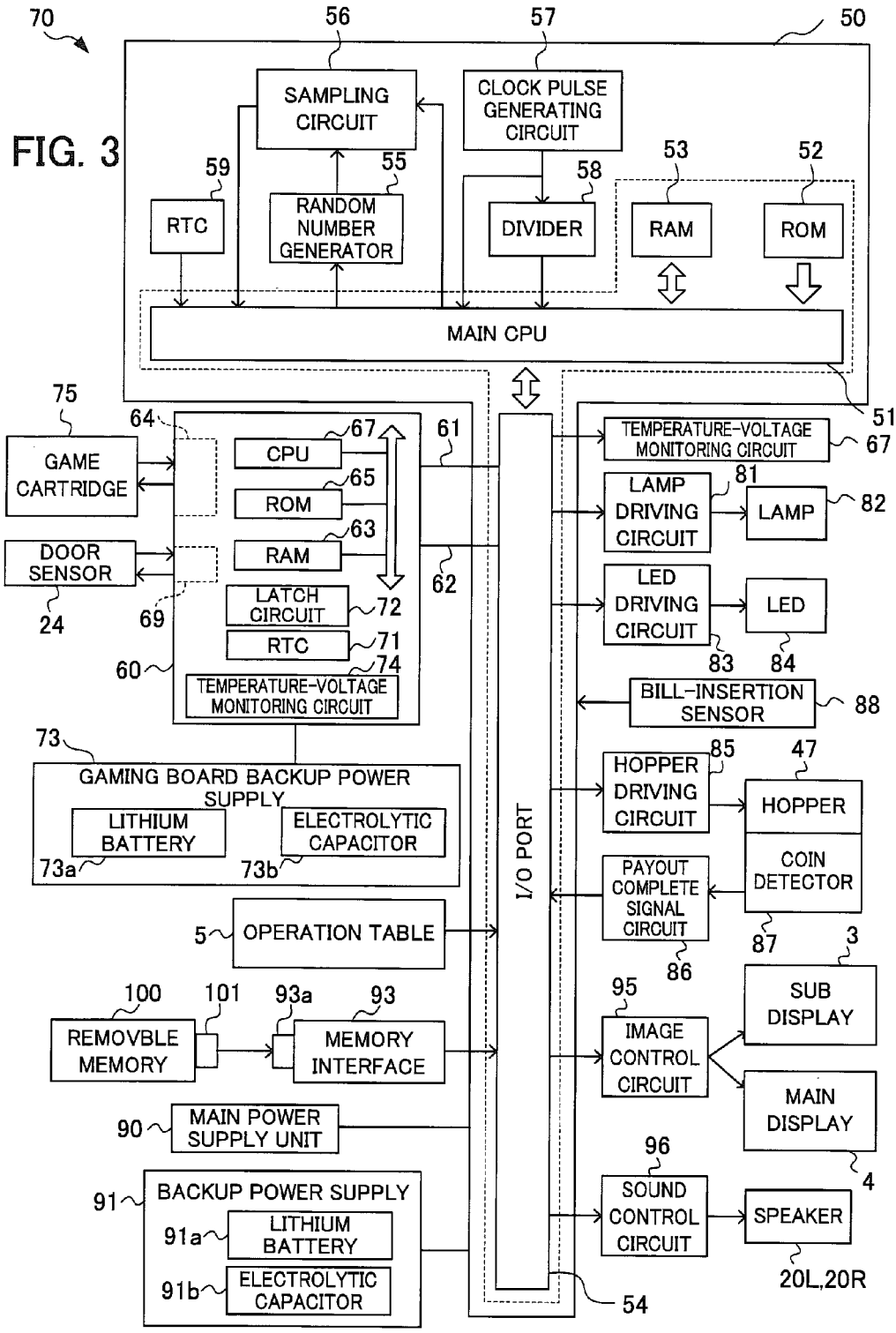
FIG. 3 is a block diagram showing a configuration of a control device of the gaming machine according to the present invention.

FIG. 3 is a block diagram showing a configuration of the control device 70. The control device 70 includes a motherboard 50 as an interface unit, and a gaming board 60. The control device 70 controls a game in the gaming machine 1, detects abnormal operations of units provided in the gaming machine 1, and records information relating to the abnormal operations as historical information. In the present embodiment, the units include, for example, the door sensor 24, the game cartridge 75 (described later), and the like.

Here, the abnormal operations indicate events that an administrator of the gaming machine 1 does not anticipate, including, for example, removing and inserting a unit from the motherboard 50 and the gaming board 60, electrically disconnecting the unit from the motherboard 50 and the gaming board 60, damaging the unit, opening and closing the front door 22, and the like. More specifically, in the present embodiment, the abnormal operations at the unit indicate, for example, opening the front door 22 accompanied by an OFF state of the door sensor 24, closing the front door 22 accompanied by an ON state of the door sensor 24, installing a game cartridge 59, removing the game cartridge 59, and the like.

The motherboard 50 includes a commercially available motherboard (a printed circuit board mounting basic components of a personal computer), and includes a main Central Processing Unit (CPU) 51, Read Only Memory (ROM) 52, Random Access Memory (RAM) 53, and an I/O port 54. The gaming board 60 is connected to the I/O port 54 via a PCI bus 61 and an IDE bus 62.

The ROM 52 stores a program of Basic Input/Output System (BIOS) to be executed by the main CPU 51, a program for acquiring historical information shown in FIG. 5 (described later), and information such as permanent data. When the main CPU 51 executes the BIOS, initialization is performed for predetermined peripheral devices, and loading process via the gaming board 60 is started for the game program and the game system program stored in the game cartridge 59. A memory device such as flash memory is employed for the ROM 52 regardless of rewritable or non-rewritable.

Figure 5:
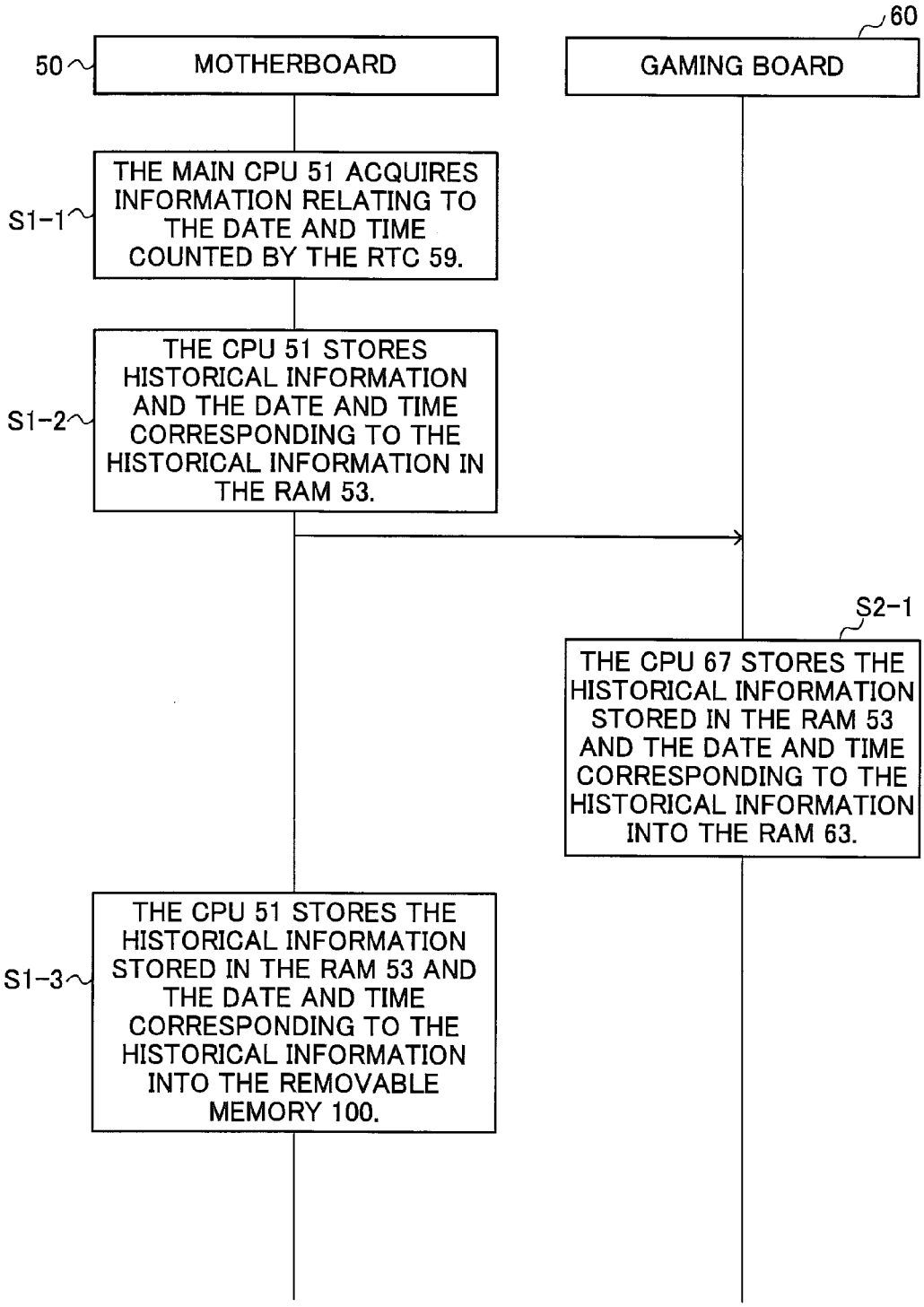
FIG. 5 is a flowchart showing processing for acquiring historical information according to the present invention.

Historical information of a unit is stored in the RAM 53 during processing for acquiring historical information shown in FIG. 5 in addition to data and programs used by the main CPU 51 in operation. The historical information, for example, includes information for identifying units such as the door sensor 24, the game cartridge 75, and the like, and information relating to the history of abnormal operation experienced at the unit.

The game cartridge 75 is a storage medium for storing gaming information used in a game. Game programs and game system programs are stored as the gaming information. The game cartridge 75 is attachable and detachable from the cartridge slot 64 provided on the gaming board 60.

The main CPU 51, the ROM 52, the RAM 53, the I/O port 54, a random number generator 55, a sampling circuit 56, a clock pulse generating circuit 57, a divider 58, a Real Time Clock (RTC) 59 as a time counter are provided on the motherboard 50.

The random number generator 55 operates based on an instruction from the main CPU 51 to generate random numbers in a predetermined range. The sampling circuit 56 extracts a random number from the random numbers generated by the random number generator 55 and inputs it to the CPU 51. The clock pulse generating circuit 57 generates a reference clock for operating the main CPU 51. The divider 58 inputs a signal indicating the reference clock divided by a constant period to the main CPU 51.

RTC 59 counts date and time, and inputs information relating to the date and time in response to an instruction by the main CPU 51. Even though the voltage supplied from the main power supply unit 90 is stopped, the RTC 59 can operate with the voltage supplied from a backup power supply 91 (described later), so that it can continue counting.

In addition, the following components are connected with the motherboard 50: a lamp driving circuit 81, a lamp 82, a LED driving circuit 83, a LED 84, a hopper driving circuit 85, a hopper 47, a payout complete signal circuit 86, a coin detector 87, a bill sensor 88, an image control circuit 95, a sound control circuit 96, and a temperature and voltage monitoring circuit 97.

The lamp driving circuit 81 outputs a signal for driving the lamp 82, allowing the lamp 82 to blink in a game as rendered effects. The LED driving circuit 83 causes the LED 84 to provide a display of blinking. The LED 84 displays an amount of credits, an acquired amount of credits, and the like. The hopper driving circuit 85 drives the hopper 47 in response to an instruction from the main CPU 51. The hopper 47 performs payout of the coins that a player has won. The hopper 47 discharges the coins to the coin tray 16 through the coin payout opening 15. The coin detector 87 counts the amount of coins discharged from the hopper 47, and transmits data of the amount of coins thus counted to the payout complete signal circuit 86. The payout complete signal circuit 86 receives the amount of coins from the coin detector 87, and inputs a signal notifying the completion of payout to the main CPU 51 when the amount reaches a set amount. When a bill is inserted into the bill insertion slot 10, the bill sensor 88 outputs a signal indicating insertion of the bill to the main CPU 51.

The image control circuit 95 controls an image display in each of the main display 4 and the sub display 3 so as to display an image of rendered effects and an image relating to information of games. The sound control circuit 96 receives an audio signal from an audio source IC, amplifying the audio signal so as to allow the speakers 20L and 20R to produce sounds such as music and voices. The temperature and voltage monitoring circuit 97 monitors temperature and voltage conditions.

In addition, a memory interface 93 is connected to the I/O port 54, and a removable memory 100 is attachably and detachably connected to the memory interface 93 via a serial port 93*a*. The removable memory 100 is a stick-shaped storage medium which includes a serial communication connector 101 connectable with the serial port 93*a*. While processing for acquiring historical information shown in FIG. 5 is performed, the removable memory 100 stores the historical information stored in the RAM 53 of the motherboard 50. In addition, since the removable memory 100 is portable, it is possible to remove the removable memory 100 from the serial port 93*a* so as to analyze the stored logs. A detailed configuration of the removable memory 100 is later described with reference to FIG. 4.

The main power supply unit 90 is connected with an external power supply (not shown) and supplies a voltage necessary for operating various components such as the main CPU 51, the ROM 52, and the RAM 53 of the gaming machine 1. Although the main power supply unit 90 is not described in detail in FIG. 3, it is connected with other components, the gaming board 60, for example, in addition to the motherboard 50 so as to supply voltage necessary for operating these components.

A backup power supply 91 in addition to the main power supply unit 90 is provided as a second power supply unit on the motherboard 50 for supplying a voltage to each of the components. Triggered by an abnormal operation where the main power supply 90 fails to supply a voltage necessary for operating each component, the backup power supply 91 starts to operate so as to supply the necessary voltage instead.

More specifically, when the main power supply unit 90 cannot supply an operating voltage to the components such as the main CPU 51, the ROM 52, and the RAM 53, which are necessary for acquiring historical information of an abnormal operation, the backup power supply 91 supplies the voltage to these components.

The abnormal operation described above includes, for example, turning off of the main power supply unit 90, cutoff of power supplied from an external power supply due to a blackout, a malfunction of the main power supply unit 90, and the like.

The backup power supply 91 not only supplies the voltage necessary for operating each component in place of the main power supply unit 90, but also can supply the voltage in cooperation with the main power supply unit 90. For an exemplary case of 5 volts as a voltage for operating the main CPU 51, the backup power supply 91 can independently supply the voltage so as to operate the main CPU 51. Furthermore, it is possible that the main power supply unit 90 and the backup power supply 91 supply 4.5 volts and 0.5 volts, respectively, so as to operate the main CPU 51.

The backup power supply 91 includes a large-capacity lithium battery 91*a* as a first secondary power supply and a large-capacity electrolytic capacitor 91*b* as a second secondary power supply. The lithium battery 91*a* and the electrolytic capacitor 91*b* are configured to be continuously charged with a voltage supplied by the main power supply unit 90.

Here, the lithium battery 91*a* and the electrolytic capacitor 91*b* operate as follows: Firstly, as described above, when the main power supply 90 cannot supply the operating voltage to each component, the lithium battery 91*a* supplies the voltage. In addition, when both the main power supply 90 and the lithium battery 91*a* cannot supply the voltage, the electrolytic capacitor 91*b* supplies the voltage.

With such a configuration in which the two secondary power supplies (the lithium battery 91*a* and the electrolytic capacitor 91*b*) are provided, either one of the two can supply the necessary voltage when a voltage supplied by the main power supply 90 is lower than required to operate the main CPU 51. In this way, it is possible to prevent failure to acquire historical information. In addition, when these secondary power supplies are replaced, for example, it is possible to continuously supply the voltage to the main CPU 51 without failure if one of the two is replaced at a time.

The gaming board 60 includes a CPU 67 as a controller, ROM 65, and RAM 63, which are connected with one another via an internal bus 68, and a cartridge slot 64 compatible with the game cartridge 75. The gaming board loads a game program and a game system program from the game cartridge 75 into the motherboard 50.

The CPU 67, the ROM 65, and the RAM 63, which are connected to one another via the internal bus 68, are connected with the motherboard 50 via the PCI bus 61. The PCI bus 61 performs signal transmission between the motherboard 50 and the gaming board 60. In addition, electric power is supplied from the motherboard 50 to the gaming board 60 via the PCI bus 61. Programs and the like shown in FIG. 5 are stored in the ROM 65. On the other hand, logs and the like created by the program are stored in the RAM 63.

The cartridge slot 64 is connected to the motherboard 50 via the IDE bus 62. The cartridge slot 64 allows the game cartridge 75 to be connected with such that the game program and the game system program stored in the game cartridge 75 are readable.

In addition to the CPU 67, the ROM 65, the RAM 63, and the cartridge slot 64, the gaming board 60 includes a door sensor connector 69, RTC 71, a latch circuit 72, a gaming board backup power supply 73, and a temperature and voltage monitoring circuit 74.

The RTC 71 counts a date and time, and outputs information relating to the date and time in response to an instruction from the main CPU 67. Even when the voltage supply from the main power supply unit 90 is stopped, the RTC 71 can operate with a voltage supplied from the backup power supply 73, so that it can continue counting. The temperature and voltage monitoring circuit 74 monitors temperature and voltage conditions.

A signal line of the door sensor 24 is connected to the door sensor connector 69, so that a detection signal that is sent from the door sensor 24 in response to opening and closing of the front door 22 enters the gaming board 60.

The latch circuit 72 detects a sudden rise and a sudden fall of an output voltage for various signal lines in the door sensor connector 69 and the cartridge slot 64 so as to detect the opening and closing of the front door 22 and the installation and removal of the game cartridge 75.

More specifically, the latch circuit 72 receives output voltages of high (H) level or low (L) level from a power line and a signal line of the door sensor connector 69 and the cartridge slot 64 as input signals. The latch circuit 72 has a logic circuit in which an output voltage of H level is configured to correlate with the front door 22 in operation, opening or closing, and the game cartridge 75 in operation, installation or removal. The CPU 67 of the gaming board 60 and the main CPU 51 of the motherboard 50 read a status of the latch circuit 72 so as to detect an abnormal operation happening in the door sensor 24 and the game cartridge 75. Each time the main CPU 51 reads a status of the latch circuit 72, it resets the latch circuit 72 to a status indicating an output voltage of L level. In addition, since the latch circuit 72 is connected with the gaming board backup power supply 73, it can continue monitoring an abnormal operation at the door sensor 24 and the game cartridge 75, even if the power supplied from the main power supply unit 90 is terminated.

Next, operations of the latch circuit 72 are described. As described above, since the main power supply unit 90 and the gaming board backup power supply 73 supply voltages to the door sensor connector 69 and the cartridge slot 64, an output voltage of the power line is continuously of an H level. In contrast, an output voltage of the signal line switches between an H level and an L level according to installation and removal of the game cartridge 75. The latch circuit 72 calculates a logical conjunction between the output voltage of the power line and the output voltage of the signal line, outputting an output voltage of an H level according to the status of the front door 22, opened or closed, and the status of the game cartridge 75, installed or removed. In this way, it is possible to detect the opening and closing of the front door 22 and installation and removal of the game cartridge 75.

Similar to the backup power supply 91 of the motherboard 50, the gaming board backup power supply 73 includes a lithium battery 73*a* as a first secondary power supply and an electrolytic capacitor 73*b* as a second secondary power supply. When triggered by an event where the main power supply unit 90 fails to supply the operating voltage necessary for each component of the gaming board 60, the gaming board backup power supply 73 is activated to supply the necessary voltage.

More specifically, when the main power supply unit 90 fails to supply the voltage to the components such as the CPU 67, the ROM 65, the RAM 63 and the latch circuit 72, which are necessary for acquiring the abovementioned logs, the gaming board backup power supply 73 supplies the voltage to these components.

Figure 4:
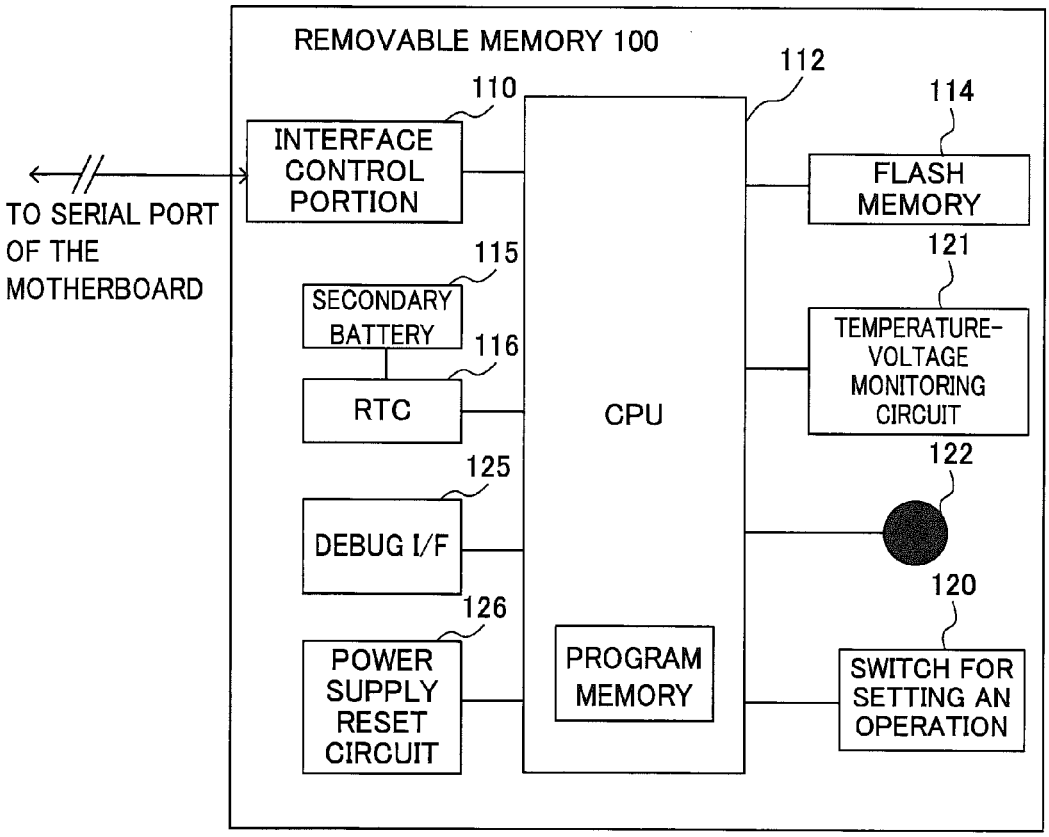
FIG. 4 is a block diagram showing a configuration of removable memory according to the present invention.

FIG. 4 is a block diagram showing an architecture of the removable memory 100. The removable memory 100 includes a CPU 112 storing an operating program and an interface control portion 110 for controlling serial communication between the serial communication connector 101 and the serial port 93*a* provided on the memory interface 93. Flash memory 114 for storing data is connected with the CPU 112. In the flash memory 114, the historical information stored in the RAM 53 of the mother board 50 transmitted via the serial communication connector 101 is stored according to proceeding shown in FIG. 5 described later. Furthermore, a RTC 116 driven by a secondary battery 115 is connected with the CPU 112.

In addition, the removable memory 100 includes a switch 120 for setting an operation, a temperature and voltage monitoring circuit 121 for monitoring temperatures and voltages, an LED 122 for displaying operating conditions, a debug I/F 125 for checking operating conditions of the CPU 112, and a power supply reset circuit 126.

The removable memory 100 is mounted in advance on the serial port 93*a* provided on the memory interface 93 of the motherboard 50. The main CPU 51 of the motherboard 50 recognizes the removable memory 100 by executing control software for controlling the removable memory 100. Historical information relating to an abnormal operation of the abovementioned units is stored as needed in the flash memory 114 of the removable memory 100.

Figure 6:
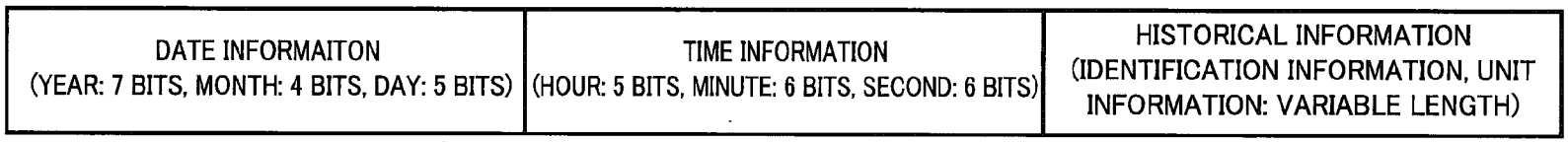
FIG. 6 is a diagram illustrating a format example of historical information and information relating to the date and time according to the present invention.

Next, a description is given of processing for acquiring historical information relating to an abnormal operation in each unit with reference to FIGS. 5 and 6.

FIG. 5 is a flowchart showing processing for acquiring historical information in the motherboard 50 and the gaming board 60. As described above, the backup power supply 91 is provided on the motherboard 50, and the gaming board backup power supply 73 is provided on the gaming board 60, respectively. Therefore, it is possible to perform the processing for acquiring historical information, even when the main power supply unit 90 fails to provide the necessary voltage.

When triggered by installation and removal of the game cartridge 75 as well as opening and closing of the front door 22, the processing for acquiring historical information is performed as external interrupt processing in the CPU 67 of the gaming board 60 and the main CPU 51 of the motherboard 50.

In Step S1-1, when detecting an abnormal operation at a unit, the main CPU 51 of the motherboard 50 acquires information relating to a date and time counted by the RTC 59.

In Step S1-2, the main CPU 51 stores the historical information relating to the abnormal operation at the unit as well as the information relating to the date and time in the RAM 53 in a predetermined format.

An example for format of historical information and corresponding information relating to the date and time is illustrated in FIG. 6. In Step S1-2, the historical information and the corresponding information relating to the date and time are stored in a predetermined data block of the RAM 53. As shown in FIG. 6, date information having 16 bits, time information having 17 bits, and historical information with variable length are stored in the RAM 53.

The date information is composed of information relating to "year", "month", and "day", bit sizes of which are 7, 4, and 5 bits, respectively. The time information is composed of information relating to "hour", "minute", and "second", bit sizes of which are 5, 6, and 6 bits, respectively. Since, not only the historical information but also the corresponding information relating to time are stored, an administrator can specify the time at which an abnormal operation has occurred, which is recorded in the historical information. This enables the administrator to perform an analysis of the historical information in more detail and more quickly.

Historical information includes identification information for identifying a particular unit at which an abnormal operation is detected and information indicating conditions of the particular unit. In the present embodiment, the identification information identifies units including the game cartridge 75 and the door sensor 24. Regarding the door sensor 24, for example, the information indicating conditions includes an ON state and an OFF state, which represent whether the door sensor 24 is open or closed. Similarly, regarding the game cartridge 75, the information indicating conditions include states of attachment and detachment, which represent whether the game cartridge 75 is attached or detached from the cartridge slot 64.

The abovementioned historical information is stored in the RAM 53 after encryption based on a predetermined algorithm. More specifically, an encrypted key is assigned to a lower 1 byte of the corresponding time information, for example. The historical information is encrypted by calculating a logical conjunction between the encrypted key and a clear text of the historical information. The encryption can enhance the confidentiality of the historical information. Consequently, it is more difficult for people other than the administrator to analyze the historical information.

With reference to FIG. 5 again, in Step S2-1, the CPU 67 of the gaming board 60 reads the historical information stored in the RAM 53 of the motherboard 50 and the information relating to the date and time corresponding to the historical information; and stores the read information in the RAM 63.

Next, in Step S1-3, the main CPU 51 reads the historical information stored in the RAM 53 and the information relating to the date and time corresponding to the historical information; and stores the read information in the flash memory 114 of the removable memory 100.

With the abovementioned processing for acquiring the historical information, the encrypted historical information and the information relating to the date and time are stored in the RAM 53 of the motherboard 50, the RAM 63 of the gaming board 60, and the flash memory 114 of the removable memory 100. Accordingly, even when the voltage supplied by the main power supply unit 90 is lower than required to operate the main CPU 51 and the CPU 67, the backup power supply 91 and the gaming board backup power supply 73 operate the main CPU 51 and the CPU 67. Therefore, even if an abnormal operation occurs in a unit against the administrator's expectation, the information relating to the abnormal operation is stored as historical information in the RAM 53, the RAM 63, and the removable memory 100. Accordingly, the contents and the location of the abnormal operation can be easily specified based on the historical information stored in the RAM 53, the RAM 63, and removable memory 100. Thus, security of the gaming machine 1 can be maintained even when the voltage at the main power supply unit 90 is lower than required to operate the main CPU 51 and the CPU 67.

It is possible to perform a parallel analysis or comparison using first historical information stored in the RAM 53 and the RAM 63 and second historical information stored in the removable memory 100. Since the historical information is stored in the removable memory 100, an analysis of the historical information can be performed without stopping the gaming machine 1. In addition, it is possible to determine whether an abnormal operation that is stored as historical information has occurred as a result of maintenance work of the gaming machine 1 or a dishonest act, by referring to the historical information stored in the memories described above.

So far, embodiments according to the present invention have been described; however, the present invention is not limited to those embodiments.

In the abovementioned embodiment, the units for which detection of an abnormal operation is performed are the door sensor 24 and the game cartridge 75; however, the present invention is not limited thereto. For example, a sensor for detecting opening and closing of the front cover 79 may be provided at the main control unit 49, and the sensor may be defined as a unit for which the detection of an abnormal operation is performed.

In the abovementioned embodiment, although the door sensor 24 and the game cartridge 75 are connected with the gaming board 60, the present invention is not limited thereto. For example, they may be connected with the motherboard 50.

What is claimed is:

1. A gaming machine, comprising:

an interface portion to which at least one unit used for executing a game is connected;

a controller that controls the unit connected to the interface portion and detects an occurrence of abnormal operation at the unit; and a main power supply for supplying power to the controller, wherein the interface portion includes a motherboard on which the controller is formed and a gaming board, the motherboard includes a first memory that stores identification information for identifying the unit, the first memory further storing historical information that includes information related to the occurrence of abnormal operation detected by the controller in connection with the identification information, and a first CPU to control the first memory, the gaming board includes a second memory for storing the identification information and the historical information stored in the first memory and a second CPU to control the second memory, and the gaming machine includes a backup power supply and a gaming board backup power supply that provide different functions and are separated from each other, wherein when a voltage supplied for the controller by the main power supply is less than the voltage required for the operation of the controller, the backup power supply supplies the controller with the voltage required for operation of the controller and the gaming board backup power supply supplies the gaming board with a voltage required for operation of the gaming board, the gaming board being connected to the motherboard and the controller via at least one bus.

2. The gaming machine according to claim 1, further comprising a removal memory that is attachably and detachably connected with the interface portion and that stores the historical information.

3. The gaming machine according to claim 2, further comprising a time counter, wherein the removal memory further stores information related to a time counted by the time counter, the time being correlated with the historical information.

4. The gaming machine according to claim 2, wherein the historical information stored in the removal memory is encrypted.

5. The gaming machine according to claim 1, further comprising a time counter, wherein the first memory further stores information related to a time counted by the time counter, the time being correlated with the historical information.

6. The gaming machine according to claim 1, wherein the backup power supply includes a first secondary power supply and a second secondary power supply, wherein the first secondary power supply of the backup power supply is charged by the main power supply, and if a voltage supplied for the controller by the main power supply is less than the voltage required for operation of the controller, the first secondary power supply of the backup power supply supplies the controller with a voltage required for the controller, and wherein the second secondary power supply of the backup power supply is charged by the main power supply, and if both voltages supplied for the controller by the main power supply and the first secondary power supply of the backup power supply are less than the voltage required for operation of the controller, the second secondary power supply of the backup power supply supplies the controller with a voltage required for the controller.

7. The gaming machine according to claim 1, wherein the historical information stored in the memory is encrypted.

8. The gaming machine according to claim 1, wherein the gaming board backup power supply includes a first secondary power supply and a second secondary power supply, wherein the first secondary power supply of the gaming board backup power supply is charged by the main power supply, and if a voltage supplied for the controller by the main power supply is less than the voltage required for the operation of the controller, the first secondary power supply of the gaming board backup power supply supplies the gaming board with a voltage required for the gaming board, and wherein the second secondary power supply of the gaming board backup power supply is charged by the main power supply, and if the voltage supplied for the controller by the main power supply is less than the voltage required for operation of the controller and the voltage supplied for the gaming board by the first secondary power supply of the gaming board backup power supply is less than the voltage required for the operation of the gaming board, the second secondary power supply of the gaming board backup power supply supplies the gaming board with a voltage required for the gaming board.

9. The gaming machine according to claim 1, wherein the interface portion further includes a signal line whose output voltage switches according to installation and removal of the unit, and the controller detects the occurrence of abnormal operation at the unit based on the output voltage of the signal line.

* * * * *